United States Patent [19]

Pentith et al.

[11] Patent Number: 4,838,614

[45] Date of Patent: Jun. 13, 1989

[54] METHOD OF EXCAVATION AND APPARATUS THEREFOR

[75] Inventors: Sybil Pentith; Gerald R. O. Pentith, both of Rotherham, United Kingdom

[73] Assignee: Dosco Overseas Engineering Limited, United Kingdom

[21] Appl. No.: 147,270

[22] Filed: Jan. 22, 1988

[30] Foreign Application Priority Data

Jul. 8, 1987 [GB] United Kingdom ..... 8716081

[51] Int. Cl.[4] ..... E21C 25/16

[52] U.S. Cl. ..... 299/15; 299/73

[58] Field of Search ..... 299/15, 61, 71, 72, 299/73, 75, 76; 125/13 R, 14

[56] References Cited

U.S. PATENT DOCUMENTS

| | | | |
|---|---|---|---|
| 2,390,562 | 12/1945 | Storrs | 299/15 |
| 3,306,663 | 2/1967 | Webster | 299/61 X |
| 3,420,577 | 1/1969 | Pentith | 299/71 X |
| 3,433,533 | 3/1969 | Webster | 299/75 X |
| 3,550,961 | 12/1970 | Hughes | 299/71 |

FOREIGN PATENT DOCUMENTS

| | | | |
|---|---|---|---|
| 562095 | 11/1957 | Belgium . | |
| 89185 | 12/1896 | Fed. Rep. of Germany . | |
| 1925156 | 11/1969 | Fed. Rep. of Germany . | |
| 2155590 | 10/1973 | Fed. Rep. of Germany | 299/71 |
| 3141763 | 6/1982 | Fed. Rep. of Germany . | |
| 823205 | 1/1938 | France . | |
| 487533 | 6/1938 | United Kingdom . | |
| 1093106 | 11/1967 | United Kingdom | 299/72 |
| 2161848 | 1/1986 | United Kingdom . | |

*Primary Examiner*—Stephen J. Novosad
*Assistant Examiner*—David J. Bagnell
*Attorney, Agent, or Firm*—Jones, Askew & Lunsford

[57] ABSTRACT

A tunnel is constructed by progressively cutting away a predetermined depth of rock from a face using rotary diamond saws. Slots are cut into the face (12) at an acute angle to the face such that first slots intersect second slots to detach blocks from the face. In one embodiment, the cutter (29) is mounted on a slide which can traverse an elongate guide 26. The guide is carried on an arm (24) which can swivel about its own longitudinal axis. A series of angularly spaced slots are cut into the face through 360° with alternate slots being cut at opposite acute angles to the face so that they intersect. A cylindrical tunnel is produced.

10 Claims, 7 Drawing Sheets

METHOD OF EXCAVATION AND APPARATUS THEREFOR

This invention relates to a method of excavation and apparatus therefor.

The invention is especially concerned with construction of tunnels, but is useful whenever it is required to excavate a recess.

Tunnels have usually been constructed by drilling holes, generally parallel to the intended tunnel direction, in a face to be excavated, inserting explosives in the holes and blasting away a short length of the intended tunnel. The resultant rubble is then removed by mechanical shovels, an arch or other support is mounted in the excavated portion and the process is repeated.

In coal mines in particular, it has been known to mill the recesses known as stable holes, which are formed at each end of a coal face. Such techniques are much cheaper and quicker than blasting techniques, but are usable only with soft mineral, such as coal itself. Where hard minerals are met, the blasting technique is normally used in a coal mine.

Another alternative is to use a large drill to drill out the tunnel. The machinery to do this is extremely expensive both to manufacture and to use and expensive techniques have to be utilised to flush out the drilled material and to dispose of the material.

The present invention provides a method of excavation (and apparatus therefor) which has many of the advantages of the drilling technique, but which is relatively cheap both in respect of the cost of the apparatus used and the cost of operation.

In accordance with this invention, there is provided a method of excavating a recess in a given direction in a face, comprising cutting a series of slots into the face, the slots being cut at an acute angle to said given direction, some of the slots intersecting with others of the slots, and said some slots being inclined to said other slots, whereby blocks of material are separated from the face.

Reference is now made to the accompanying drawings, wherein.

Figure 1:
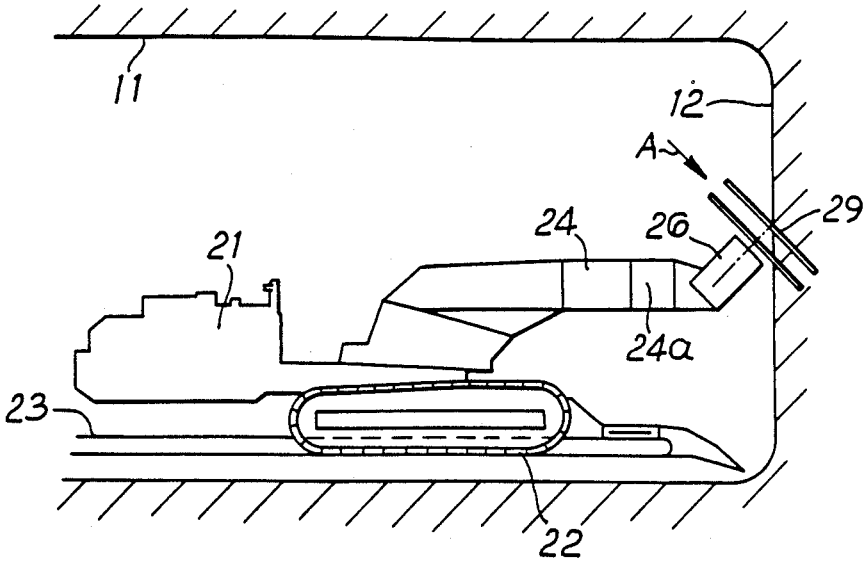
FIGS. 1 is a side elevation illustrating a first embodiment of apparatus according to the invention.
Figure 2:
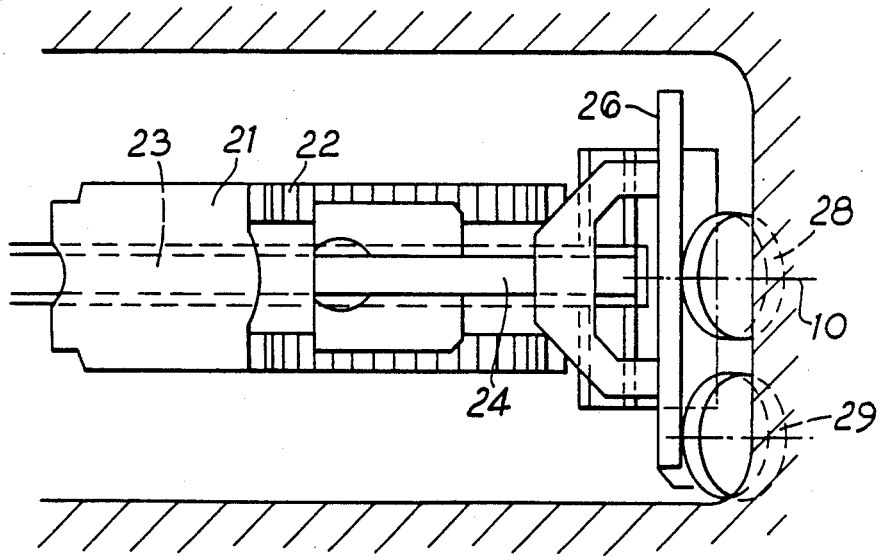
FIG. 2 is a plan view of the first embodiment.
Figure 3:
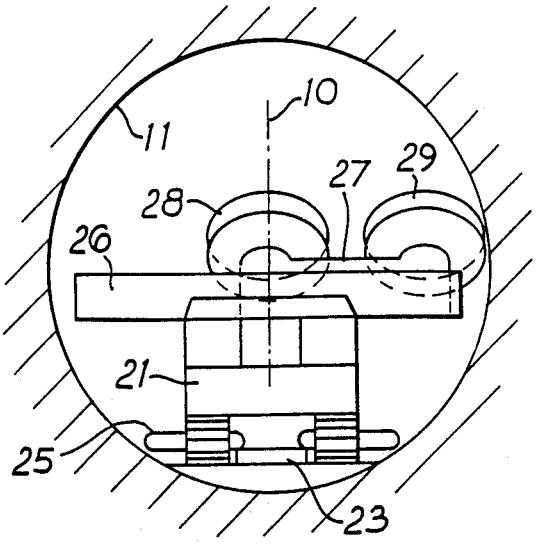
FIG. 3 is an end elevation of the first embodiment.

Referring to FIGS. 1 to 3, there is illustrated apparatus for forming a cylindrical tunnel 11 by cutting into a face 12. The apparatus comprises a self-advancable body 21 mounted on caterpillar tracks 22 for advancing the apparatus in the tunnelling direction, generally perpendicular to the face 12. Other types of self-advancing mechanisms may be used. The apparatus cuts blocks of material from the face in a manner to be described and includes conveyors 23, 25, extending in the tunnelling direction. The conveyors are arranged to collect the blocks which fall from the face and is continuously operable for removing the blocks as they fall.

An arm 24 is swivellably mounted on the body 20 about its own axis and this arm extends from the body in a forward direction so as to lie substantially along the axis of the cylindrical tunnel 11. At its end remote from the body, the arm carries a transverse guide 26 which extends along a diameter of the tunnel with a small clearance at each end. A slide 27 is mounted in the guide for movement therealong.

The slide 27 rotatably mounts a pair of rotary cutters 28, 29, spaced along the guide 26. The slide includes angle-setting means (not shown) which set the cutters at an acute angle to the face 12 and to the tunnel axis. This angle may be about 45°. Adjustment of the angle during a cutting cycle is not required.

The cutters are mounted in a secondary guide (not shown) on the main guide 26. This secondary guide permits movement of the two cutters 28, 29, relative to the main guide 26, into the face at said acute angle at the initiation of a cutting operation. This movement is indicated by arrow 'A' in FIG. 1.

Drive means is provided for swivelling the arm 24 (e.g. by means of a hydraulic motor 24*a*) driving the slide 27 along the guide 26, driving the cutters in the secondary guide and for rotating the cutters. These drive means may be electrical and/or hydraulic with electrical control and involves only normal workshop, engineering skills to put into practice.

The cutters are preferably discs with diamond saw teeth, but could be cutters of other forms.

The apparatus is used to cut a series of slots into the face 12, such that the slots intersect to cut blocks from the face, which are carried away on the conveyors. Each slot extends substantially the full diameter of the tunnel and the slots are angularly spaced at the face 12.

In order to cut one slot, the cutters 28, 29 are rotated at high speed and the cutters are advanced in the secondary guide so as to cut into the face 12 a predetermined distance. The slide 27 is then moved along the main guide 26, so that the cutters cut a slot along the diameter at which the guide 26 lies. The cutters are then withdrawn and the arm 24 is swivelled by a few degrees, so that the slide lies on a different diameter. The cutters are then advanced again to cut into the face and the slide traverses the main guide 26 in reverse direction to cut a second diametral slot. This cycle is repeated until the arm has been angularly moved through 360° about axis 10 (FIG. 2).

After the arm has been swivelled through 180°, the slots are cut in an angular direction towards those already cut, so that each slot intersects with an existing slot. This is achieved without adjustment of the cutters, since the cutting direction reverses at 180° of rotation. This intersection of slots means that pieces of material are separated from the face and fall onto the conveyors. Most of the material can be removed in this way, leaving only small pieces at the periphery, which are readily removable by hammer blows, or by other means as described hereafter.

The whole apparatus can then be advanced for a repeat cycle to extend the tunnel.

Figure 6:
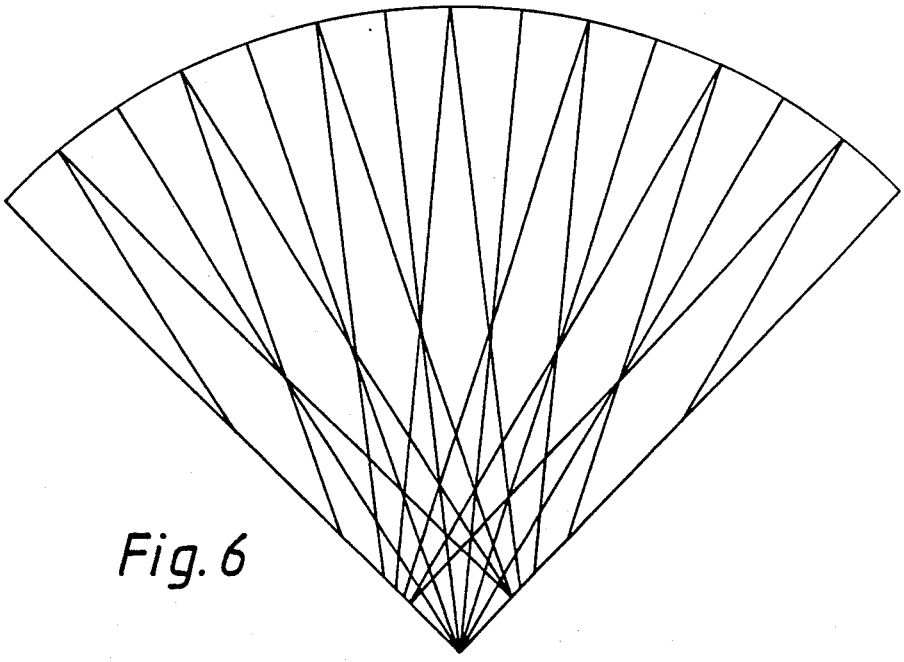
FIG. 6 shows the cutting pattern effected by the first embodiment in normal, excavating mode.

The cutting pattern effected by the method described above is illustrated in FIG. 6.

Figure 4:
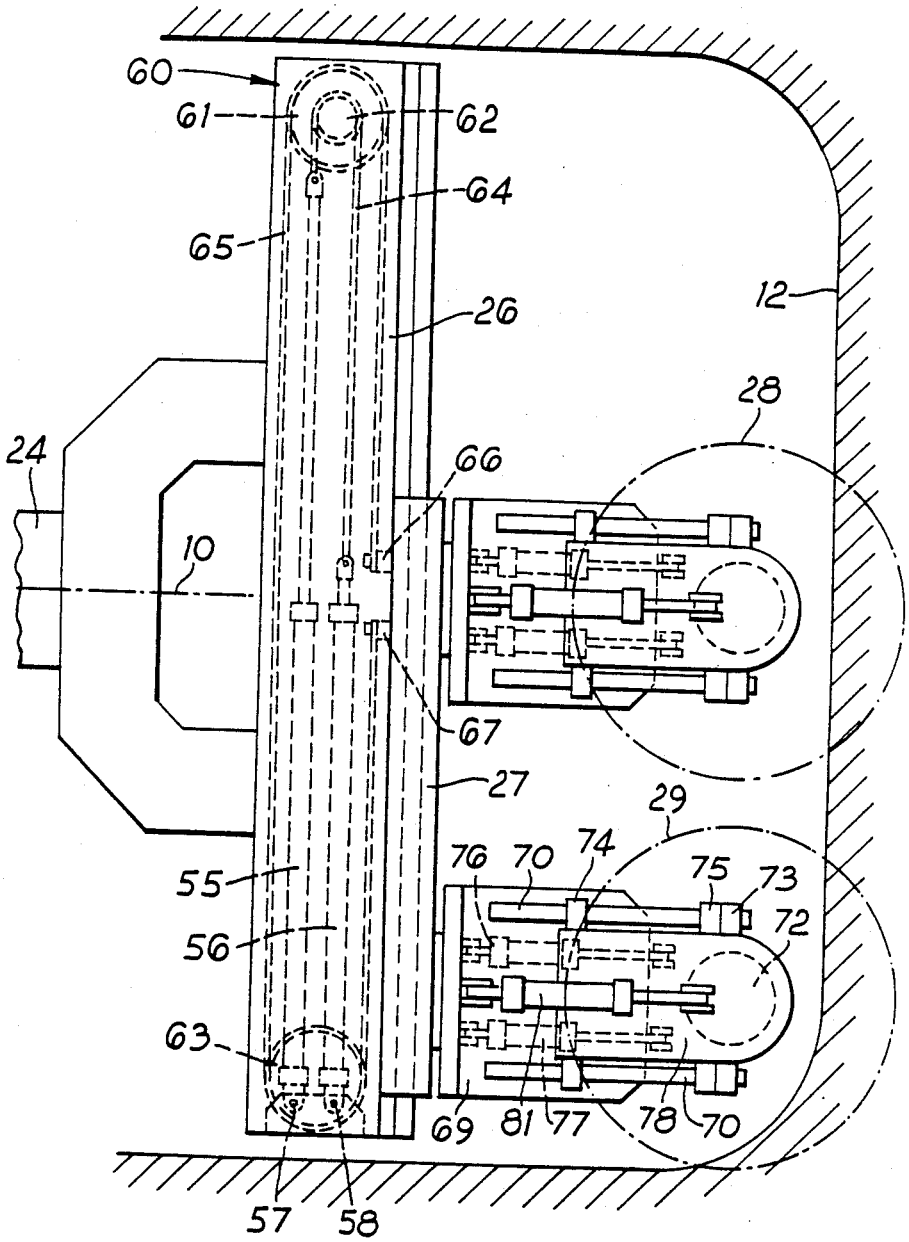
FIG. 4 is an enlarged detail view of part of the first embodiment in plan view.
Figure 5:
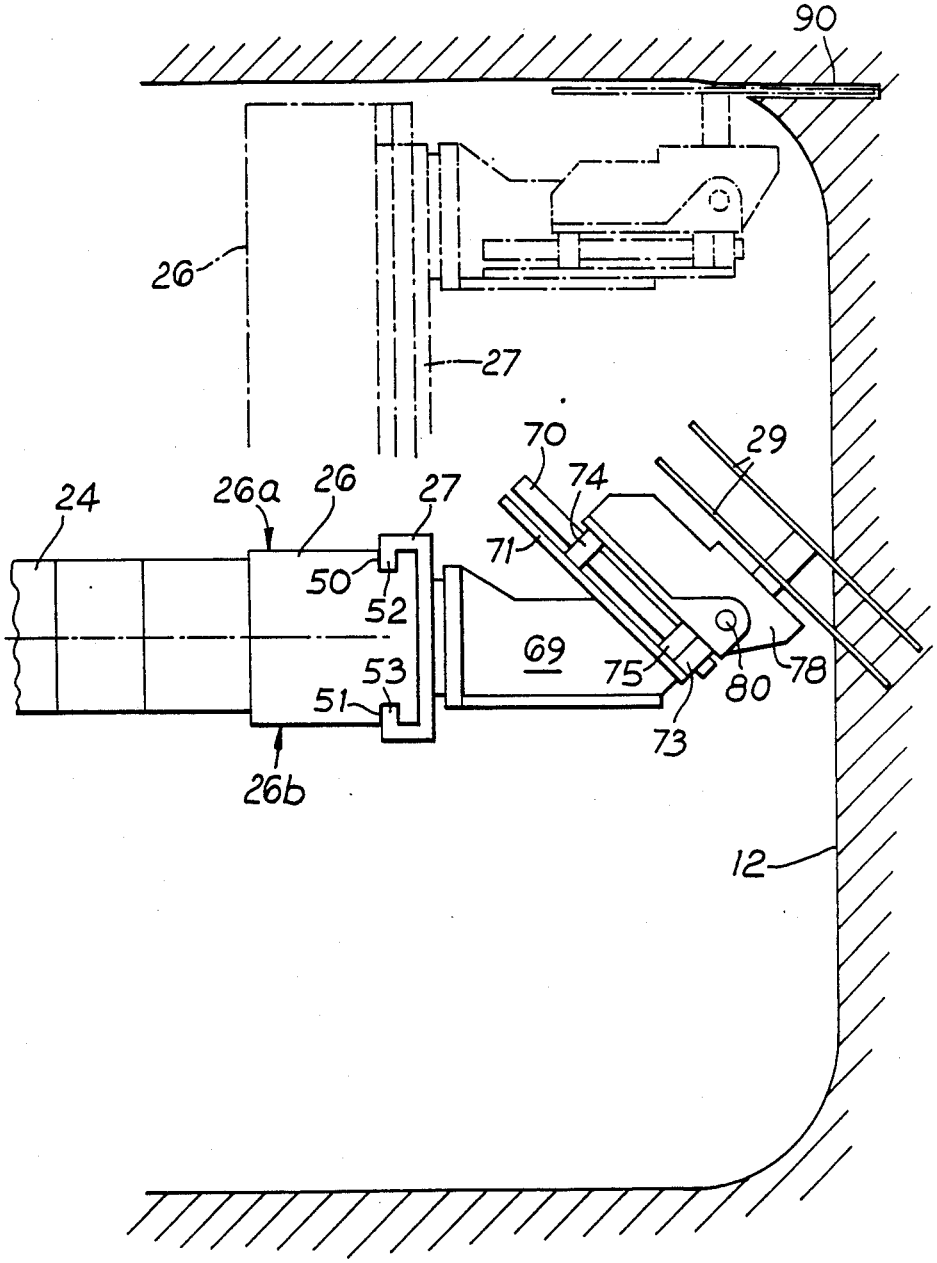
FIG. 5 is an enlarged detail view of part of the first embodiment in side elevation with a cutting head shown in normal excavating mode in whole lines and in an edge-cutting mode in dash lines.

More detail of the apparatus is disclosed in FIGS. 4 and 5. As shown in these Figures the transverse guide 26 is shown to have a pair of approved longitudinal grooves 50, 51 in upper and lower faces 26*a*, 26*b* respectively. The slide 27 is generally of channel shape and fits over the transverse guide. The slide has inwardly extending longitudinal flanges 52, 53, which engage in the grooves 50, 51 to captivate the slide on the guide for longitudinal movement relative thereto.

The mechanism for effecting longitudinal movement of the slide comprises a pair of hydraulic rams 55, 56 mounted in the guide 26 and pivotally fixed at one end to the guide at 57, 58 at one end of the guide. At the opposite end of the guide, is rotatably mounted a double-gear wheel 60 having a larger diameter gear 61 fixed to a smaller diameter gear 62. At said one end of the guide is mounted a single gear wheel 63 of the same diameter as gear wheel 61. A first chain 64 links the two rams 55, 56 and is looped over the smaller diameter gear 62. A second chain 65 passes over the two larger diameter gears 61, 63 and is connected at its ends to two adjacent bosses 66, 67 on the slide 27.

In operation, the hydraulic rams work in opposite mode in unison to rotate the smaller gear 62 through the first chain 64. The gear wheel 60 is thereby rotated and the second chain 65 is moved to cause the slide to move along the guide.

Each cutter 28, 29 is mounted in a respective cutting head having a main body 69. In each head, a subframe 71 is pivotally mounted on the body 69 about a pivotal mounting 80. The sub-frame has a pair of bosses 73 mounting parallel guide rods 70. A carrier 78 is slidably mounted on the sub-frame 71 for linear movement along the guide rods 70, the carrier having apertured lugs 74, 75 engaged with the guide rods.

A motor 72 is mounted on the carrier 78 and drivingly connected to the cutter 29.

Angular adjustment of the cutter 29 to set the cutting angle is effected by a hydraulic ram 81 pivotally mounted between the main body 69 and the sub-frame 71.

Linear advancement of the cutters into the face and retraction of the cutters is effected by hydraulic rams 76, 77 mounted between the sub-frame 71 and the carrier 78.

As previously mentioned, hammers may be used to break off the remaining protruberances at the periphery of the excavated tunnel. The apparatus illustrated in FIGS. 1 to 6 can alternatively be used to avoid this procedure. To permit this operation, the cutters 28, 29 can be rotated between a normal excavating mode and an edge-cutting mode. The finishing mode is shown in dash lines in FIG. 5.

Figure 7:
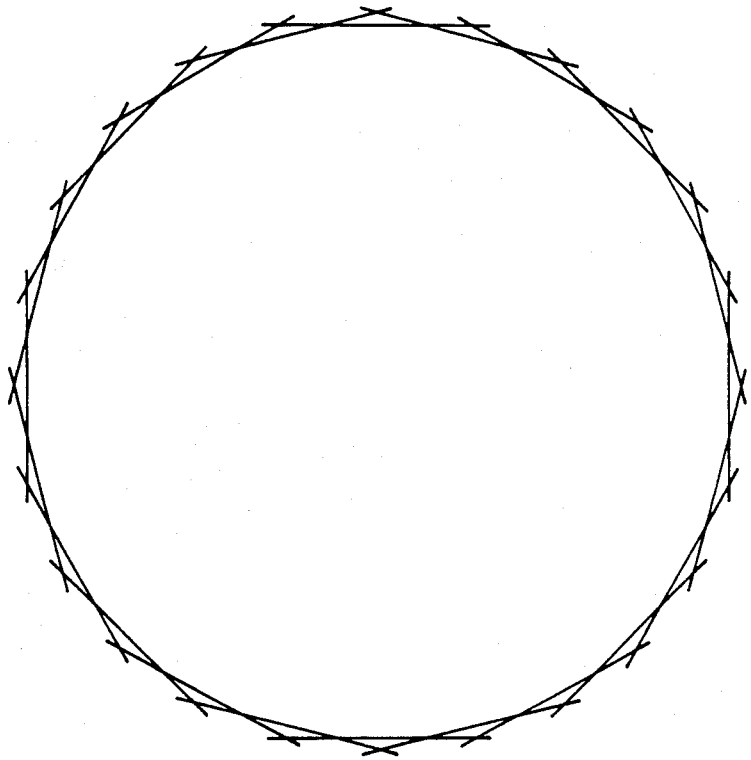
FIG. 7 shows the cutting pattern effected by the first embodiment in the edge-cutting mode.
Figure 8:
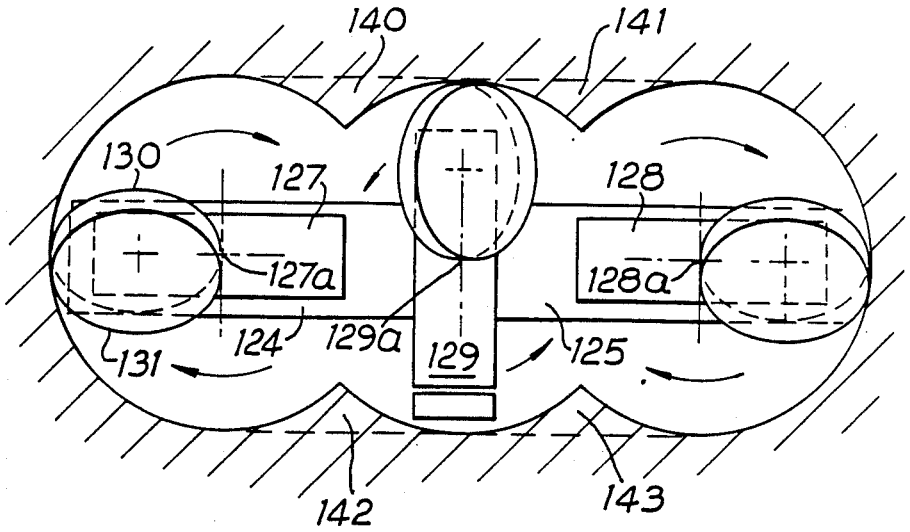
FIG. 8 is an end elevation of a second embodiment of apparatus according to the invention.
Figure 9:
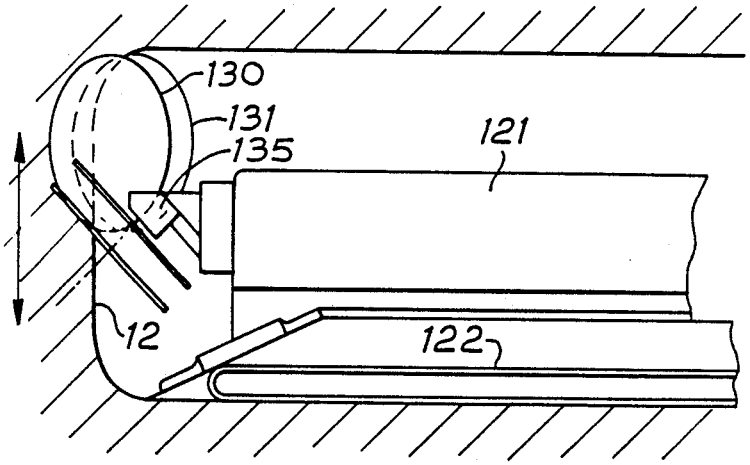
FIG. 9 is a side elevation of the apparatus of FIG. 8.
Figure 10:
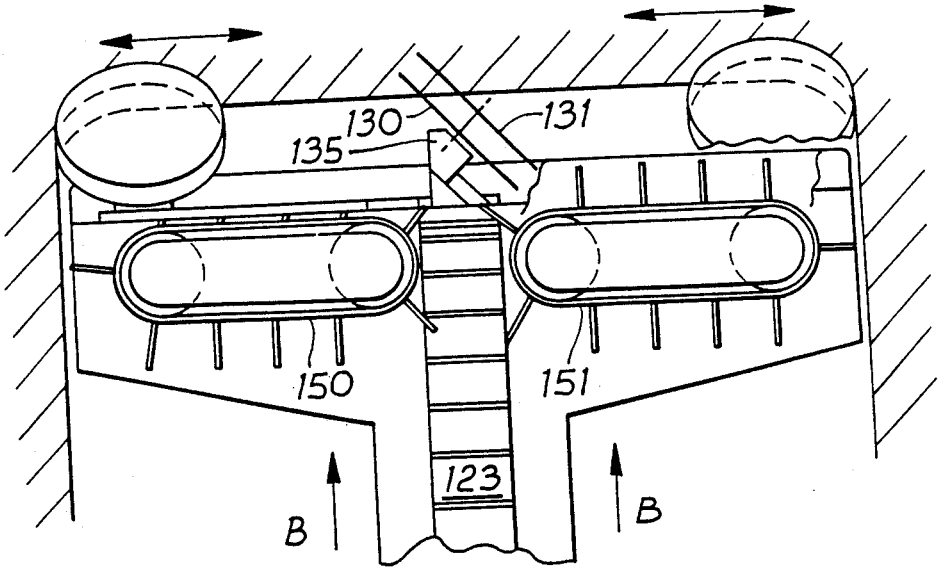
FIG. 10 is a plan view of the apparatus of FIGS. 8 and 9.
Figure 11:
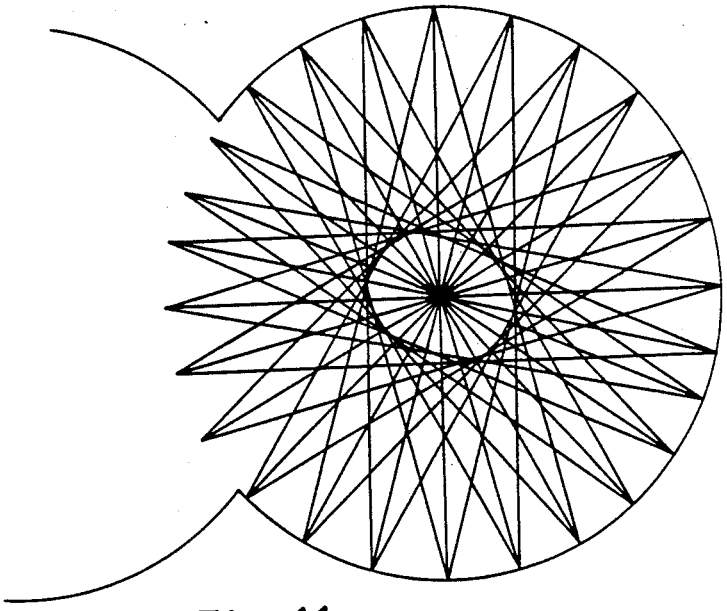
FIG. 11 illustrates the normal excavating operation of one cutting head of the apparatus of FIGS. 8 to 10.

In this mode, the cutters, such as 29, are arranged generally parallel to the length of the tunnel being excavated. The cutters are used before the normal excavation procedure is commenced to cut a generally circular slot in the face to be excavated to define the circumference of the excavation. This means that the formation of protruberances at the circumference is avoided. Alternatively, the procedure could be used to remove the protruberances after an excavating cycle. The generally circular slot is effected by a multiplicity of adjacent chordal cuts. The pattern of cutting is illustrated in FIG. 7.

To effect chordal cutting, one cutting head is located at an end of the transverse guide 26. In this cutting head, the cutting is angularly adjusted to be generally parallel to the tunnel length by operating the hydraulic ram 81. This position is illustrated in the dash line position of FIG. 5. The cutter is then advanced to cut into the face, by means of the hydraulic rams 76, 77, and then retracted. For this purpose, only one cutting blade is used, forming a chordal slot 90, and one cutting blade in each head may also be used for the excavating operation.

The main arm 24 is then swivelled through a predetermined angle and the chordal cutting operation is repeated. This procedure is repeated through 360°.

In order to produce a wider tunnel, apparatus as disclosed in FIGS. 8 to 11 may be used.

This apparatus, again has a self-advancable body 121 mounted on caterpillar tracks 122 for advancing the apparatus in the tunnelling direction B. A central conveyor 123 is provided for removing debris.

A pair of beams 124, 125 are mounted on the body 121. The beams extend in directions opposite to each other in alignment and perpendicular to the direction of tunnelling B. Three arms, 127, 128, 129 are swivellably mounted on the body about aligned axes. A first arm 127 is pivoted on one of the beams 124, a second arm 128 is pivoted on the other beam 125 and the third arm is pivoted centrally of the beams, about axes 127*a*, 128*a* and 129*a* respectively. The axes all extend in the tunnelling direction B.

Each arm carries a guide member 135, slidable on the arm along a path acutely angled to the tunnelling direction B and to the face 12. Each guide member rotatably mounts a pair of rotary cutters 130, 131 which lie parallel to the path of the slide. The guide member includes angle setting means (not shown) which set the cutters at said acute angle to the face 12 and to the tunnelling direction B. The guide member 135 is mounted on a slide (not shown) for movement along the respective arm 129.

Drive means is provided for swivelling the arms 127, 128, 129, for driving the slides along the respective arms, for driving the guide members and for rotating the cutters.

Each pair of cutters is operated in a similar manner to that of the embodiment previously described. The three pairs of cutters operate simultaneously to cut angled slots into the face 12. The cutters are then moved by their slides 135 along the arms 127, 128, 129 to cut an elongate slot. The cutters are then retracted and all three arms 127, 128, 129 are swivelled through a predetermined angle for a repeat cutting operation. This procedure is repeated through 360°.

The tracks of the three cutters overlap and they are interdigitated so that there is no interference during the cutting cycle. After a complete cutting cycle, small pieces remain attached at the periphery, as in the previous embodiment, which can be removed by hammer blows. In order to provide a flat roof and floor, ridges 140 to 143 remaining between the regions cut by the three pairs of cutters can also be removed by hammer blows, or by means of the cutters.

Auxiliary conveying means 150, 151 are provided alongside corresponding beams 125, 126 for collecting material removed by the cutters on the first 127 and second 128 arms. This material is conveyed to the central conveyor 123 for removal from the site.

The methods of cutting tunnels described above are substantially cheaper to carry out than existing methods and rock of all types can be cut by the apparatus described. It is only necessary to vary the rotary cutting speed according to the hardness of the rock being cut.

The methods described above enable the tunnel supports to be placed close to the face after each section has been cut. This is not possible with blasting techniques and there is much greater safety in carrying out the method according to the invention.

We claim:

1. Apparatus for excavating a recess in a given direction in a face, comprising:

a body having a longitudinal axis;

an arm extending from the body in a forward direction so as to lie substantially along the axis of the given direction;

a swivellably driven member operative for locating the arm in a multiplicity of angularly spaced positions around its axis;

transverse guide means mounted on the member;

support means drivably movable along the transverse guide means;

cutting means mounted on the support means;

means on the support means for advancing the cutting means relative thereto towards the face whereby the cutting means cuts into the face;

means between the transverse guide means and the cutting means for locating the cutting means to cut into the face at an acute angle thereto, whereby the support means may be driven along the transverse guide means to cut a transverse angled slot in the face; and said member being swivellably adjustable for cutting a multiplicity of such angled slots through substantially 360°, whereby said angled slots intersect to remove blocks of material from the face.

2. Apparatus according to claim 1 including conveying means for conveying away said removed blocks of material.

3. Apparatus according to claim 1, including means for adjusting the angle of the cutting means relative to the face from a position generally perpendicular thereto, whereby perpendicular slots may be cut into the face around the area to be excavated.

4. Apparatus for excavating a recess in a given direction in a face, comprising:

cutting means;

first drive means for operating the cutting means for cutting slots in the face;

support means for the cutting means;

first guide means on the support means for guiding the cutting means towards the face;

second drive means for advancing the cutting means along the first guide means for cutting into the face and for retracting the cutting means;

transverse second guide means mounting said support means;

third drive means for driving the support means along the second guide means whereby the cutting means cuts a transverse slot in said face;

means between the second guide means and the cutting means for locating said cutting means at an acute angle to said face whereby an angled slot is cut in the face; and adjustment means for rotationally adjusting the transverse second guide means about an axis through substantially 360°, whereby a multiplicity of the acutely-angled slots may be cut in the face at positions spaced around said axis for cutting blocks from the face.

5. Apparatus according to claim 4 wherein the cutting means comprises a rotatably driven diamond tipped circular saw blade.

6. Apparatus according to claim 4 wherein said second and third drive means include hydraulic rams.

7. Apparatus according to claim 6, wherein said third drive means comprises an arrangement of gears on the transverse second guide means interconnected by chain means, the chain means being connected with said support and said gears being rotatably driven by hydraulic ram means.

8. A method of excavating a recess in a given direction in a face comprising cutting a series of slots into the face, the slots being cut at an acute angle to said given direction, some of the slots intersecting with others of the slots, whereby blocks of material are separated from the face, and cutting each slot across an axis extending in said given direction and cutting said slots at angular spacings about said axis through substantially a complete circle.

9. A method according to claim 8, in which a plurality of series of slots are cut through substantially respective circles which circles are side-by-side and overlap.

10. A method according to claims 8 or 9, including the steps of cutting a multiplicity of interconnected chordal slots around the circumference of the region to be excavated.

* * * * *